US005129644A

United States Patent [19]

Thomason et al.

[11] Patent Number: 5,129,644

[45] Date of Patent: Jul. 14, 1992

[54] METHOD AND APPARATUS FOR WORKPIECE ALIGNMENT

[75] Inventors: David G. Thomason, Kennesaw; Yoichi Enomoto, Duluth, both of Ga.

[73] Assignee: Juki America, Inc., Duluth, Ga.

[21] Appl. No.: 526,668

[22] Filed: May 18, 1990

[51] Int. Cl.[5] ..... B65H 7/02

[52] U.S. Cl. ..... 271/227; 271/250; 271/254; 271/255; 271/238; 271/240

[58] Field of Search ..... 271/227, 250, 248, 249, 271/253, 254, 255, 236, 238, 239, 240; 198/456, 345.1

[56] References Cited

U.S. PATENT DOCUMENTS 4,657,239 4/1987 Ikesue et al. ..... 271/227
4,874,160 10/1989 Yamamoto ..... 271/253 X

FOREIGN PATENT DOCUMENTS 0043148 4/1981 Japan ..... 271/227
0190145 10/1984 Japan ..... 271/248
0087148 5/1985 Japan ..... 271/236

*Primary Examiner*—H. Grant Skaggs
*Assistant Examiner*—Carol Lynn Druzbick
*Attorney, Agent, or Firm*—Morgan & Finnegan

[57] ABSTRACT

A workpiece is aligned in the X, Y coordinate plane at a predetermined X, Y reference coordinate. Separate X and Y coordinate transports rapidly transport and align the workpiece. Deceleration means prevent the workpiece from slipping on the work surface. An adjustable, stationary workpiece engaging plate speeds the cycle time of the device by providing dual coordinate alignment of the workpiece. Sensors are provided to detect the presence of a workpiece properly aligned in the X, Y coordinate plane. The sensors may be either individually connected or coupled through a control means to previous and succeeding workstations in such a manner that the invention can interrupt the "fault chain" that occurs when a workpiece becomes fouled along the assembly line.

14 Claims, 3 Drawing Sheets

METHOD AND APPARATUS FOR WORKPIECE ALIGNMENT

FIELD OF THE INVENTION

This invention relates to a method and apparatus for rapidly and accurately aligning and positioning workpieces that are to be subjected to manufacturing sewing processes, and more particularly for aligning and positioning shirt cuffs, shirt collars, or other components of wearing apparel that are subjected to various manufacturing processes.

BACKGROUND OF THE INVENTION

Prior to the automation of commercial scale apparel manufacturing lines, much of the detail-oriented work to be performed on individual apparel components required significant operator intervention. A shirt cuff provides a typical example. Preparing a shirt cuff blank for the finished shirt requires, at a minimum, two discrete manufacturing operations. First, a button hole must be cut and sewn-finished at one end of the cuff blank. Next, the cuff blank must be rotated 180° so that one or more buttons may be sewn onto the opposing end of the cuff blank. Prior to assembly line automation worker intervention was required to manually position a cuff blank under the machine which cut and sew-finished a button hole. Next, a worker would have to position it under another machine that would attach one or more buttons to the opposing end of the shirt cuff.

Widespread reliance on manual labor to accomplish these functions can be costly, both from the point of view of the quality of the work and the time required for such work.

Numerous ways exist to remedy the problem of product quality and efficient output. One way is to create some sort of control system to ensure accuracy in performing the manufacturing operations. For example, aligning means or marks can be placed on the work surface below each individual machine to assist the operator in correctly aligning the work piece for that particular manufacturing operation. Another way is to mark the work piece in the exact location where the operation is to be performed. Both these solutions are less than desirable for higher speed commercial operations. Both continue to require significant worker intervention and demand that the worker become accustomed to rapid coordination of the workpiece with the individual control systems. Although a highly skilled worker can achieve a good output rate employing these solutions, under the constraints of productivity individual workers will differ. Moreover, the commercial output of the machines continues to remain dependent on individual worker capabilities.

As previously mentioned, the preferred solution to excessive worker intervention was to automate the manufacturing lines. Automation reduced the need for individual worker intervention and contributed to higher rates of output and better accuracy and hence, quality, in the finished product. However, even before the process of automatic assembly can commence, the automatic system should be provided with a mechanism for entering the workpiece into the system in a regular manner.

It is therefore an object of the present invention to provide a simple and efficient means to rapidly and accurately align workpieces.

It is a further object of the present invention to provide a simple and efficient way to rapidly and accurately align a workpiece prior to subjecting the workpiece to a manufacturing process.

It is yet another object of the present invention to provide means and method for rapidly and accurately aligning a workpiece at a reference location with a minimum of worker intervention.

SUMMARY OF THE INVENTION

These and other objects of the invention are met by providing an apparatus and method according to the invention. The invention, in preferred embodiments, includes separate X coordinate and Y coordinate workpiece alignment mechanisms for transporting a given workpiece from a supply location to a predetermined (X, Y) reference coordinate position on a work surface. A stationary X and Y coordinate alignment means can be added to speed the task of the moving alignment means by engaging an edge of the workpiece as it is transported to the predetermined (X, Y) coordinate location.

The (X, Y) reference coordinate is user determinable, and may be changed (or refined) either by manually adjusting individual X and Y coordinate alignment means, or by employing a computer or other system that coordinates and controls all the manufacturing devices along the assembly line. This has the further advantage of allowing multiple reference coordinates to be established.

In one embodiment, the X and Y coordinate alignment mechanism includes moving plates, which are positioned flush with the work surface and are actuated by pneumatic cylinders having moving pistons. The cylinders are mounted below the work surface. Shock absorbers are preferably provided to decelerate the moving plates as the predetermined (X, Y) reference coordinate is approached. This allows the cylinder to rapidly position the workpiece while at the same time decelerating the workpiece so that inertial forces do not affect accurate alignment.

The invention may be equipped with X and Y coordinate sensors that detect the presence of the workpiece upon arrival at the predetermined X, Y reference coordinate. The sensors allow the alignment means to "communicate" with a common control system or directly with preceding and successive manufacturing workstations, thereby providing coordination of the manufacturing processes. At the same time, this communication by the alignment means allows the device to operate as an independent unit capable of interrupting the so called "fault chain" that can occur when a workpiece has become fouled along the assembly line.

BRIEF DESCRIPTION OF THE DRAWINGS

The invention will be described in greater detail by way of reference to the following drawings, in which.

DETAILED DESCRIPTION OF THE DRAWINGS

One method to coordinate manufacturing processes that rely on accurate positioning and alignment is to create a base or reference position from which subsequent manufacturing processes derive their individual, precise location on the workpiece. That is, the (X, Y) coordinate position of each manufacturing operation on the workpiece is independently related to a common (X, Y) reference coordinate. A common (X, Y) reference coordinate will allow the various manufacturing machines to operate, to some extent, independently of one another, contributing to greater efficiency and fewer problems in correcting the manufacturing process. Since the machines can take full advantage of their rapid ability to accurately coordinate their operations by referring to a common reference coordinate, individual operator intervention is decreased to a great extent.

Figure 1:
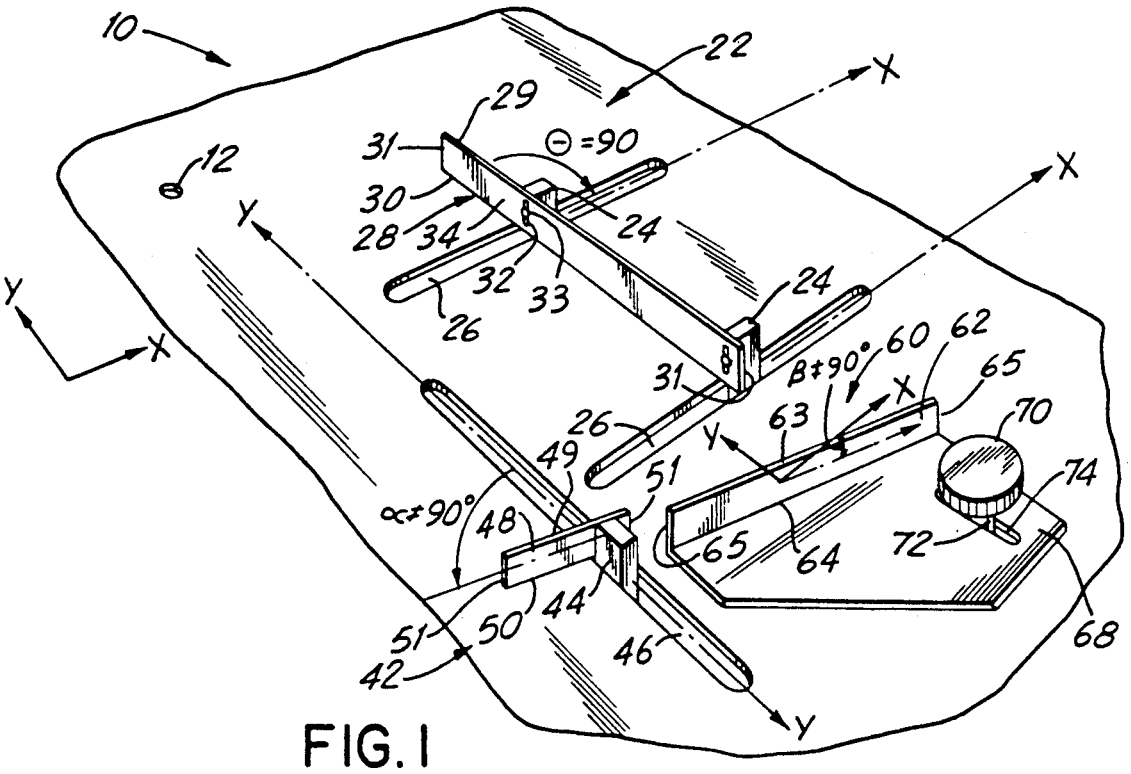
FIG. 1 is a top perspective view of a preferred embodiment of the invention.
Figure 3:
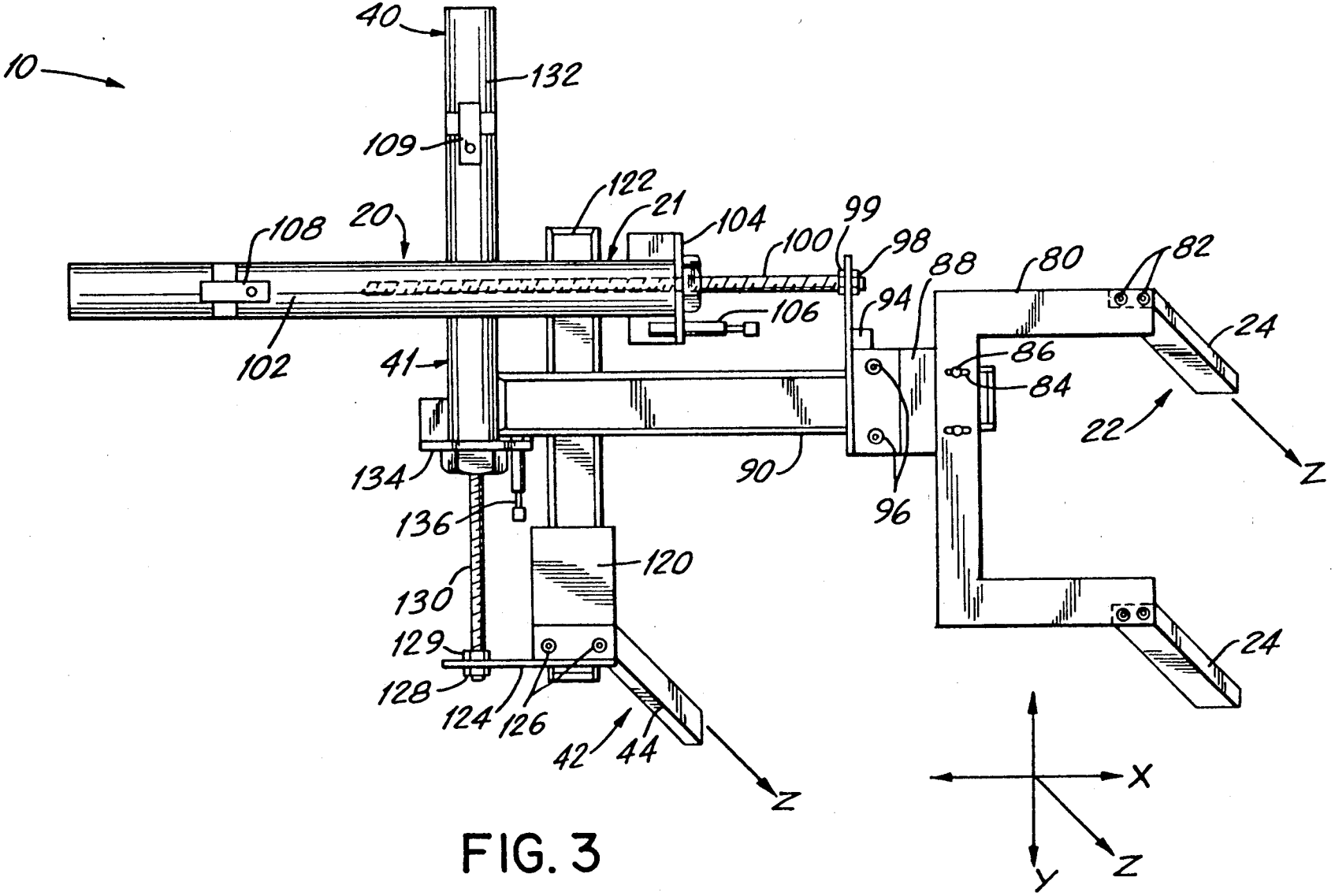
FIG. 3 is a bottom view of the embodiment of FIG. 1 showing the mounting arrangement of the various components.

FIGS. 1 and 3 illustrate, in schematic form, one preferred embodiment of the invention, including an X coordinate alignment means 20, a Y coordinate alignment means 40, a stationary X, Y coordinate alignment means 60, an X coordinate sensing means 108, and a workpiece sensing means 12. The X coordinate alignment means further includes X coordinate workpiece transporting means 22 and X coordinate actuation means 21. Similarly, the Y coordinate alignment means 40 includes Y coordinate workpiece transporting means 42 and Y coordinate actuation means 41.

Figure 2:
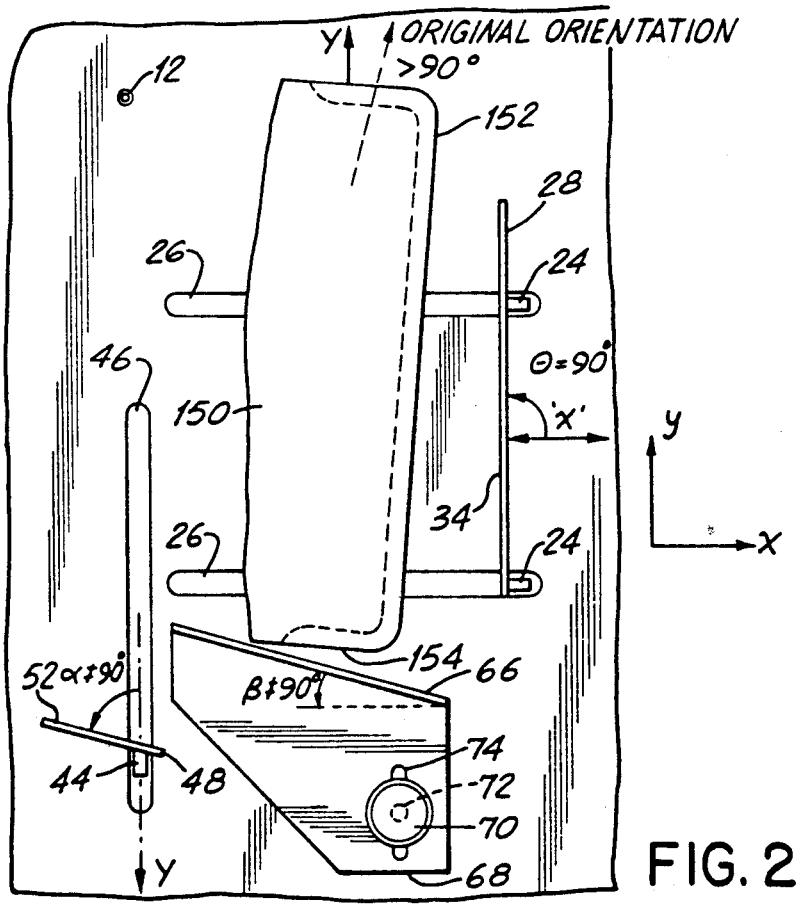
FIG. 2 is a top view of the embodiment of FIG. 1, prior to actuation, showing the relationship of the X, Y coordinate transporting means to the workpiece.

FIG. 2 is a top view of the embodiment of FIG. 1 illustrating a workpiece 150 that is to be aligned. Here, the workpiece 150 comprises a shirt cuff blank, but it is readily apparent that various other components of wearing apparel can be aligned according to the present invention.

Referring now to FIG. 1, a flat work surface 10 may be provided as the medium upon which alignment of the workpiece takes place. The work surface 10 is preferably smooth, but it is apparent that it can be textured or roughened depending on the type of workpiece being aligned. For example, if the workpiece 150 is made of a fabric that possesses a lustrous sheen, such as silk or satin, little friction results between workpiece 150 and the relatively smooth work surface 10. Consequently, inertial forces created during the alignment process would cause workpiece 150 to slip on work surface 10. Creating a non-smooth work surface, such as by texturing or by roughening, enhances friction to promote proper alignment of workpiece 150 upon work surface 10.

Referring noW to FIGS. 1 and 2, an X coordinate transporting means 22 may include a flat plate 28 having a top edge 29, a bottom edge 30, side edges 31, and a workpiece engaging surface 34. The bottom edge 30 is substantially flush with work surface 10 but is slidably movable thereon. The plate 28 is oriented so that engaging surface 34 is substantially perpendicular to the X coordinate axis, as shown by the angle 8 made by plate 28 and the X coordinate axis. The plate 28 may also be contoured (not shown) in a manner which would permit workpiece 150 to be correctly positioned for further processing by succeeding workstations.

Plate 28 is adjustably supported on vertical support bars 24 which protrude through parallel slit-like openings 26 in work surface 10. The openings 26 run parallel to the X coordinate axis. Threaded screws or bolts 33 pass through slotted openings 32 in plate 28 and are rotatably engaged in threaded bores (not shown) on vertical support bars 24.

The vertical orientation of plate 28 with respect to work surface 10 may be adjusted by loosening screws 33 and sliding plate 28 up or down, as desired, the slots 32 serving as a guide. Screws 33 are then re-tightened to hold plate 28 securely in place. Of course, the slots 32 need not be vertically oriented, but can be disposed in a variety of manners, e.g., horizontally, diagonally, etc., allowing the orientation of plate 28 to be adjusted accordingly.

Again referring to FIGS. 1 and 2, Y coordinate transporting means 42 may include a flat plate 48 having a top edge 49, a bottom edge 50, side edges 51, and an engaging surface 52. Like plate 28, plate 48 is arranged so that bottom edge 50 is flush with work surface 10 but is slidably movable thereon. However, plate 48 is oriented when aligning workpiece 150 so that engaging surface 52 preferably forms an acute angle with the Y coordinate axis, as indicated on FIG. 1 by the angle $\alpha$. As will be apparent from FIGS. 2, 4 and 5, and to be more fully explained later, this acute angle serves to assist plate 48 in exerting a clockwise turning force upon workpiece 150 to insure that workpiece 150 is properly aligned upon arrival at the (X, Y) reference coordinate.

Plate 48 is fixedly supported on a vertical support bar 44 that protrudes through a slit-like opening 46 in work surface 10. In the depicted embodiment, plate 48 is attached to vertical support bar 44 in a preset orientation, e.g. the angle $\alpha$ has a predetermined, fixed value. However, it will be apparent to those skilled in the art that plate 48 may be adjustably supported upon vertical bar 44 to allow for adjustment of angle $\alpha$.

As shown in FIGS. 1, 2, 4 and 5, the invention also may include a stationary (X, Y) coordinate alignment means 60. As will be elaborated later, stationary alignment means 60 reduces the time required to align workpiece 150 by providing simultaneous X and Y coordinate alignment of workpiece 150.

Stationary alignment means 60 can consist of a wall 62, vertically oriented to work surface 10, having a top edge 63, a bottom edge 64, side edges 65, and an engaging surface 66. Bottom edge 64 is flush with work surface 10. As in the case of plate 48, wall 62 may be oriented so that engaging surface 66 forms an acute angle $\beta$ with respect to the Y coordinate axis. Although the wall 62 is vertically oriented to work surface 10, it is apparent that a non-vertical orientation may be preferable in some instances dictated, for example, by the types, shape, texture, etc. of the workpiece 150 to be aligned (it will be noted that the foregoing also applies to plates 28 and 48).

In the depicted embodiment, the wall 62 can be formed from an upturned edge of a flat mounting plate 68. The plate 68 is provided with a slot 74, and is rotatable about a threaded bolt or screw 72 which passes through slot 74. The screw or bolt 72 is received at one end in a threaded opening (not shown) in work surface 10, a knob 70 being fixedly attached to the other end of bolt or screw 72. The knob 70 serves as means to transmit (or release) tightening force to plate 68 upon rotation of bolt or screw 72, so that plate 68 may be immovably held, upon the tightening of knob 70, against work surface 10.

Upon the release of tightening force, plate 68 may be rotated about bolt 72 or slid along slot 74 to vary the (X, Y) coordinate placement of wall 62 on work surface 10; similarly, one may vary the angle $\beta$ made by engaging surface 66 with the X or Y coordinate axes. Angle $\beta$ is one determinant in the degree of turning force exerted upon workpiece 150 by stationary alignment means 60 and assists in simultaneous X and Y coordinate alignment of the workpiece. Moreover, the ability to vary the placement of wall 62 on work surface 10 permits larger as well as smaller workpieces 150 to take advantage of the simultaneous (X, Y) coordinate alignment and time savings contributed to the invention by stationary alignment means 60.

FIG. 2 presents a top view of the embodiment of FIG. 1 prior to engagement of the various alignment means with the workpiece. Workpiece 150 generally has an edge 152 that engages with workpiece engaging surface 34, and an edge 154 that engages with engaging surfaces 66 and 52, respectively. Note also the position of a workpiece sensor 12, preferably being photo electric but not so limited. As will be more fully explained, workpiece sensor 12 detects the presence of workpiece 150 and communicates this information to a common control system such as a programmable logic controller. Alternatively, this information may also be directly relayed to prior and succeeding workstations.

Referring now to FIG. 3, the vertical bars 24 of X coordinate transporting means 22 are fixedly mounted to a flat U-shaped bracket 80 via threaded screws or bolts 82. Threaded screws or bolts 86 pass through slotted openings 84 in bracket 80 and are received in threaded openings (not shown) in a bearing 88. This adjustable mounting system permits fine as well as broad adjustment of the X coordinate orientation of plate 28 upon work surface 10.

In the depicted embodiment, bearing 88 travels in rail 90, and together they provide the means by which plate 28 travels back and forth across work surface 10. Rail 90 is mounted parallel to the bottom of work surface 10 via brackets or other means (not shown) so that a gap exists between work surface !0 and rail 90. Rail 90 is oriented parallel to the X coordinate axis so that vertical bars 24 may travel the length of slots 26 without interference. Bearing 88 and rail 90 are a well known means to provide axial motion, and are typical of commercially available linear motion bearing systems such as those manufactured by THK or IKO.

X coordinate transport means 22 is actuated via X coordinate actuating means 21, which can include a pneumatic cylinder 102 having a moving piston 100 having means (not shown) for controlling and adjusting the movement of piston 100. Cylinder 102 is mounted via brackets or other means (not shown) so that a gap exists between work surface 10 and cylinder 102.

X coordinate sensor 108 is mounted on the surface of cylinder 102. In the depicted embodiment, X coordinate sensor 108 magnetically detects the presence of piston 100 upon termination of its distance of travel (known as the "stroke length") within cylinder 102. Piston 100 travels a user determinable distance within the cylinder 102 (the portion of piston 100 within cylinder 102 is illustrated by dotted lines, as shown in FIG. 3) so that plate 28 will be aligned with the predetermined X coordinate upon the arrival of piston 100 at its stroke length. The stroke length of piston 100, a basic parameter for the accurate alignment of workpiece 150 upon work surface 10 in the X coordinate direction, can be user adjustable by manipulating the control means.

In the depicted embodiment, sensor 108 is located upon cylinder 102 so that it will detect the end of piston 100 once it has traveled the predetermined stroke length that corresponds to proper alignment of plate 28 on the X coordinate axis. Of course, sensor 108, like workpiece sensor 12, communicates with prior and succeeding workstations to communicate the presence of workpiece 150 properly aligned in the X coordinate axis. Although in the depicted embodiment sensor 108 magnetically detects piston 100 as it approaches its stroke length, photoelectric or other sensors may be substituted.

Adjustment of the stroke length of piston 100 is a useful parameter for proper positioning of workpiece 150 on work surface 10. In turn, this leads to increased efficiency and greater accuracy in aligning the workpiece. Additionally, workpieces of various shapes and sizes are more easily accommodated by the invention by allowing for this adjustment. The method of adjusting the stroke length can include repositioning the location of sensor 108 on cylinder 102, but other adjustment means are readily substituted.

Bearing 88 may be fixedly connected to the free end of piston 100 via bracket 94. As such, bracket 94 serves as a link between X coordinate transport means 22 and X actuation means 21. Screws or bolts 96 secure bracket 94 to bearing 88. The free end of piston 100 may be threaded and provided with a threaded nut 99. The threaded free end of piston 100 passes through an opening (not shown) in bracket 94, proceeding only as far as threaded nut 99, which comes to rest against bracket 94. Threaded nut 98 is then tightened onto the free end of piston 100 to firmly secure bracket 94 thereto. (Of course, one skilled in the art will realize that placing washers, gaskets or the like between threaded nut 99 and bracket 94 provides a manner of controlling and modifying the X coordinate alignment of workpiece 150 by adjusting the distance that plate 28 travels on work surface 10.)

A rapid motion piston 100 may be provided within cylinder 102 to provide for rapid operation of the invention. However, with such rapid motion piston and cylinder arrangements, the sudden stopping motion that occurs when piston 100 has reached its stroke length causes workpiece 150 to slide upon work surface 10. Such unintended slip can cause misalignment and positioning difficulties.

One solution to the problem is to provide deceleration means 106 that slows the motion of plate 28 as piston 100 nears the end of its stroke. The preferred embodiment of deceleration means 106 is a shock absorber, although one skilled in the art will realize that other means could be substituted. Here, deceleration means 106 is mounted parallel to cylinder 102 via a bracket 104 that is fixed to the end of cylinder 102. Deceleration means 106 is positioned to engage bracket 94 or bearing 88 as piston 100 nears its stroke length. This engagement decelerates plate 28 and prevents inertia from causing workpiece 150 to slip on work surface 10 once plate 28 has come to rest.

It will be apparent to one skilled in the art that varying or altering the positioning of deceleration means 106 will change when bracket 94 or bearing 88 is engaged, thereby lengthening (or shortening) the stroke length of piston 100 to regulate the alignment of plate 28 along the X-coordinate axis. Also, by adjusting the degree of dampening provided by deceleration means 106 (such as by employing air or gas regulated shock absorbers) the corresponding deceleration of plate 28 may also be controlled.

Similar in construction to X coordinate alignment means, Y coordinate alignment means 40 is generally mounted to the bottom of work surface 10 in the gap between X coordinate alignment means 20 and the bottom of work surface 10. Like its X coordinate counterpart, Y coordinate alignment means 40 includes (not shown) means for affixing vertical bar 44 to a bearing 120. Since only one vertical bar is used for Y transport means 42, vertical bar 44 may be affixed to a side of bearing 120 or, as in the case of X transport means 22, vertical bar 44 may be mounted to a bracket (not shown) which in turn is adjustably or fixedly attached to bearing 120. Bearing 120 and rail 122, similar to that used for X coordinate alignment means 20, provides the means by which plate 48 travels along the Y coordinate axis, said rail 122 being mounted parallel to the Y coordinate axis so that vertical bar 44 will not interfere with slotted opening 46.

Actuation means 41, comprising a pneumatic cylinder 132 with moving piston 130, propels plate 48 back and forth across work surface 10. In the depicted embodiment, Y coordinate sensor 109, located on cylinder 132, magnetically detects the presence of piston 130 at the end of its stroke length. Of course, sensor 109 need not be magnetic; photoelectric or other means may be readily substituted. Like piston 100, the stroke length of piston 130 may be adjusted, either by changing the position of sensor 109 on cylinder 132, or employing other user determinable adjustment means. Adjusting the stroke length of piston 130, a useful parameter for workpiece alignment, helps assure rapid and accurate positioning of workpiece 150 on work surface 10, as well as allowing the invention to accommodate workpieces of various shapes and sizes.

A bracket 124 connects the threaded free end of piston 130 to bearing 120 via threaded nuts 128 and 129 and screws or bolts 126. Similar to X alignment means 20, screws 126 may pass through slots (not shown) on bracket 124 and washers or gaskets (not shown) may be placed between threaded nut 129 and bracket 124, all intended to adjust the alignment of plate 48 along the Y coordinate axis. Deceleration means 136, mounted parallel to cylinder 132 on bracket 134, can be positioned to engage bracket 124 or bearing 120 to decelerate the motion of plate 48. Deceleration means 136 can comprise a shock absorber, and its various parameters can be altered (as explained with respect to deceleration means 106) to regulate the alignment of workpiece 150 in the Y coordinate axis.

Figure 4:
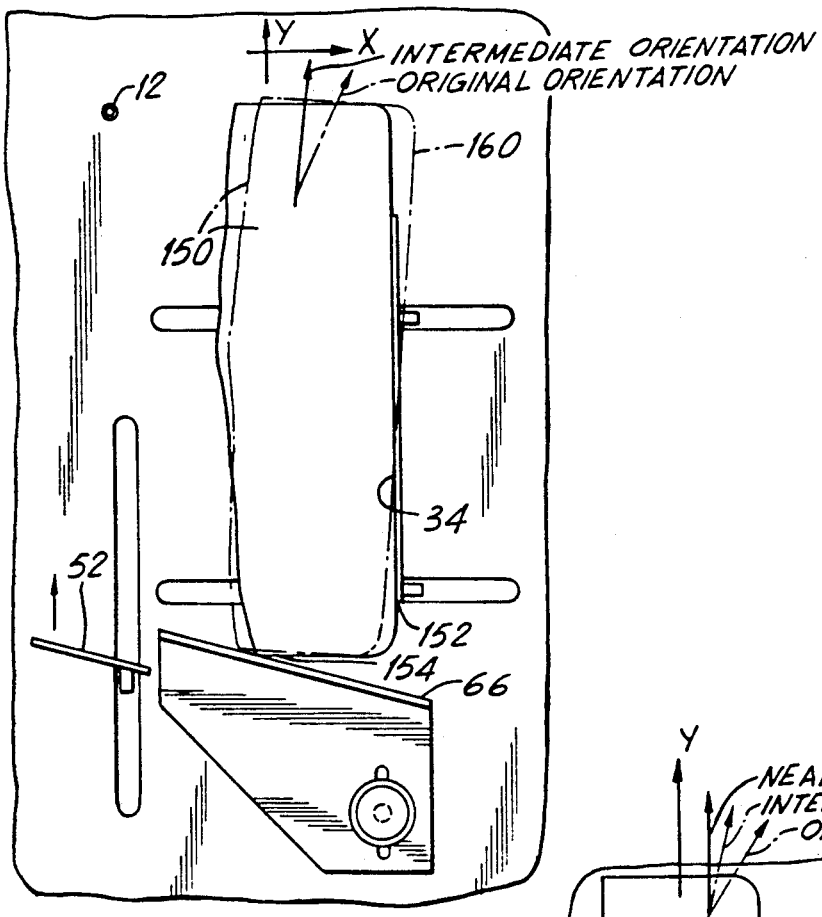
FIG. 4 is a top view of the embodiment of FIG. 1 showing workpiece alignment at an intermediate stage.
Figure 5:
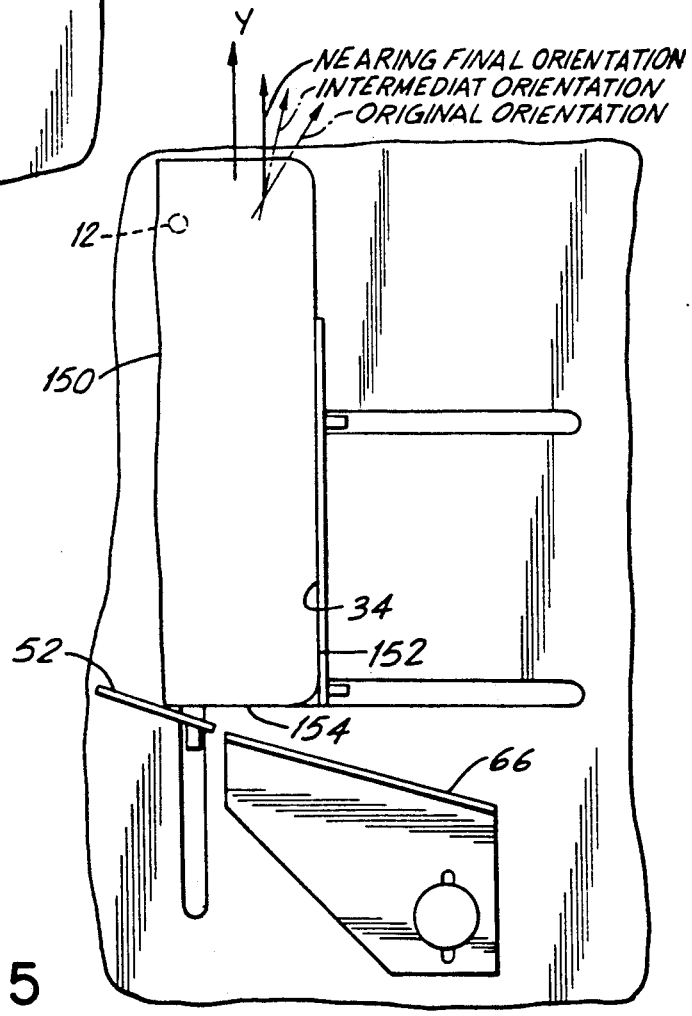
FIG. 5 is a top view of the embodiment of FIG. 1 showing workpiece alignment at a near final stage.

Reference is made to FIGS. 2, 4, and 5 to describe the operation of the invention. As previously mentioned, FIG. 2 is representative of the invention prior to engagement of work surfaces 34, 52, 66 with workpiece 150. Here, workpiece 150 has been either manually or mechanically placed onto work surface 10. Neither X-transport means 22 or Y transport means 42 has begun to travel towards workpiece 150. As can be seen, the longitudinal axis of workpiece 150 is skewed with respect to the Y coordinate axis.

FIG. 4 shows workpiece 150 at an intermediate stage of alignment. X transport means 22 first engages the edge 152 of workpiece 150 via engaging surface 34 of plate 28. One will note that the X transport means 22 is the first to be actuated and serves to begin the alignment of workpiece 150 by transporting it in the X coordinate direction. One will further observe that as workpiece 150 is pushed by plate 28 across the work surface, edge 152 begins to square against surface 34, contributing to the proper alignment of the workpiece.

As workpiece 150 continues to travel in the X coordinate direction, edge 154 will eventually engage surface 66 of stationary (X, Y) alignment means 60. As discussed above with regard to FIG. 2, surface 66 is oriented at an angle not parallel to either of the X, Y coordinate axes, but is placed at angle $\beta$ acute to the Y coordinate axis. The purpose for this orientation is to provide simultaneous X, Y coordinate orientation of workpiece 150. This decreases the cycle time necessary to align workpiece 150 with X and Y coordinate alignment means 20, 40, directly promoting the efficiency and output rate of the invention.

Upon contact with surface 66, the continued travel of workpiece 150 in the X coordinate direction causes said workpiece to rotate counter clockwise against surface 66, thereby beginning to align in the Y coordinate direction. This Y coordinate alignment is occurring simultaneous to the continued alignment of workpiece 150 by plate 28 in the X coordinate direction. Note that Y transport means 42 has begun to travel in the Y coordinate direction but has not yet made contact with edge 154 of workpiece 150.

FIG. 5 shows workpiece 150 as it nears final alignment at the desired X, Y reference coordinate. Note that edge 152 remains in contact with surface 34. However, edge 154 is no longer in contact with surface 66 of stationary (X, Y) alignment means 60, but has now been engaged by engaging surface 52 of plate 48 in order to complete the Y coordinate orientation of workpiece 150. As in the case of surface 66, engaging surface 52 is oriented at an angle $\alpha$ parallel to neither the X, Y coordinate axes, also serving to promote the rotational orientation of workpiece 150 in the Y coordinate axis by squaring the edge 152 of workpiece 150 along engaging surface 34. Most importantly, the motion of engaging surface 52 pushes workpiece 150 in the Y coordinate direction to align it at the proper Y reference coordinate.

In order to assure that only properly aligned workpieces continue down the assembly line, and to prevent a new workpiece from being placed for alignment in case a malfunction occurs in alignment of the preceding workpiece, the device may utilize workpiece sensor 12 in combination with X coordinate sensor 109 or Y coordinate sensor 109. The function of workpiece sensor 12 is to detect the presence of workpiece 150 in the alignment area of work surface 10.

As previously discussed, X coordinate sensor 108 transmits a signal when piston 100 has reached its stroke length, which, in turn, corresponds to the proper placement of workpiece 150 in the X-coordinate axis. Similarly, Y coordinate sensor 109 transmit a signal when piston 130 has reached its stroke length, corresponding to proper placement of workpiece 150 in the Y coordinate axis.

By coordinating the activation of preceding and successive manufacturing workstations when sensor 12 and either sensors 108 or 109 have signalled, the device may achieve a rapid and efficient manufacturing cycle time. By allowing operation with either of sensor 108 or sensor 109 signaling in combination with sensor 12, the device achieves greater efficiency because sensors 108 and 109 may not necessarily signal at the same time.

When succeeding and preceding workstations are activated upon the activated upon the receipt of a signal from sensor 12 and the first of the signals from sensors 108 or 109, the workpiece 150 will already be properly aligned when engaged by a succeeding workstation (the second of sensors 108 or 109 signalling at some interim time between when the workstations have been activated and when workpiece 150 is engaged). However, if desired, one may also require all three sensors 12, 108 and 109 signal before succeeding and preceding workstations are activated.

By way of example, the two sensor signalling mode will be explained using material sensor 12 and X coordinate sensor 108; it being understood, of course, that Y sensor 109 may be substituted for X sensor 108. Workpiece sensor 12 and X coordinate sensor 108 thus signal that a workpiece is properly aligned prior to activation of succeeding and preceding workstations. This operation may be explained by reference to the concept of logic circuits, where a "0" signals that no aligned workpiece exists, whereas a "1" signals the presence of an aligned workpiece.

In one preferred embodiment, sensors 12 and 108 do not themselves measure alignment of workpiece 150, but rather relay the "presence" of a properly aligned workpiece 150, relying on the proper adjustment of X and Y coordinate alignment means 20, 40 to relay dependable data to a common control system, such as a PLC, or directly to preceding and succeeding workstations. Employing only two parameters, e.g., the proper adjustment of X and Y coordinate alignment means 20, 40, as opposed to further including proper adjustment of both X and Y coordinate sensors 108, 109, decreases the probability that a misaligned workpiece 150 will be permitted to proceed down the assembly line. However, one skilled in the art will realize that sensors which independently measure the alignment of workpiece 150 can be employed, either in place of or in conjunction with sensors 12 and 108, and can utilize, for example, laser or strobe light measurement.

Thus, when the workpiece 150 is detected, material sensor 12 transmits a logical "1" to the PLC or directly to preceding and succeeding workstations.

The detection of workpiece 150 by material sensor 12 substantially coincides with piston 100 of X actuating cylinder 102 arriving at the end of its stroke length. As previously discussed, sensor 108 is positioned along cylinder 102 to magnetically detect piston 100 when it has traveled the proper stroke length. At that point, sensor 108 signals a logical "1" to the PLC (or directly to preceding and succeeding workstations) to announce the presence of a workpiece properly aligned in the X coordinate axis. Now that both sensors 108 and 12 transmit the presence of workpiece 150 properly aligned in the X and coordinate axis and, as previously explained, substantially if not fully aligned in the Y coordinate axis, aligned workpiece 150 is ready to proceed to a succeeding workstation, thereby allowing a new workpiece to be placed on work surface 10 for alignment. Recall that prior to the time that workpiece 150 will be engaged by a succeeding workstation, Y coordinate sensor 109 should have signalled that workpiece 150 is properly aligned in the Y coordinate axis. However, it is not necessary for sensor 108 to signal to activate the preceding and succeeding workstations.

Note also that all three signals from sensors 12, 108, or 109 may be provided, if desired, to activate preceding and succeeding workstations. This is referred to as a three sensor mode.

Note that by arranging for signals from both sensor 12 and sensors 108 or 109, (or, in three sensor mode, from all three sensors 12, 108 and 109) to transmit alignment prior to allowing workpiece 150 to proceed to other workstations (or allowing a new workpiece to be placed for alignment), the invention is capable of operating independently of preceding and succeeding workstations, thereby breaking the so called "fault chain" that arises in automated lines when a fouled workpiece causes a "pileup" of unprocessed workpieces preceding the interruption. The invention also greatly reduces labor costs. By reducing individual worker intervention, the associated problems and costs considered earlier are significantly reduced.

It will be apparent that other and further forms of the invention may be devised without departing from the spirit and scope of the appended claims, it being understood that this invention is not to be limited to the specific embodiments shown.

We claim:

1. An apparatus for simultaneously aligning in the X and Y coordinate axes, a workpiece upon which manufacturing operations are to be performed, said apparatus comprising:

an X coordinate alignment means, said X coordinate alignment means comprising means for transporting said workpiece in a path along the X-axis to a predetermined X-coordinate position on a work surface;

a Y coordinate alignment means, said Y coordinate alignment means comprising means for transporting said workpiece in a path along the Y-axis to a predetermined Y-coordinate position on said work surface;

a stationary X-Y coordinate alignment means provided along the path of movement of said workpiece and cooperating with said X and Y coordinate alignment means for simultaneous alignment of said workpiece in the X and Y coordinate axes;

an X coordinate sensing means for ascertaining placement of said workpiece at said predetermined X-coordinate position which is provided at a fixed position relative to said predetermined X-coordinate position;

a Y coordinate sensing means for ascertaining placement of said workpiece at said predetermined Y-coordinate position which is provided at a fixed position relative to said predetermined Y-coordinate position;

material sensing means for detecting the presence of said workpiece on said work surface; and control means for controlling operation of said apparatus, said control means responsive to signals generated by said X coordinate sensing means, said Y coordinate sensing means and said material sensing means.

2. The aligning apparatus according to claim 1, wherein a workstation is engaged when said control means determines the presence of said workpiece.

3. The aligning apparatus according to claim 1, wherein said X coordinate alignment means further comprises means for decelerating the motion of said transporting means.

4. The aligning apparatus according to claim 1, wherein said Y coordinate alignment means further comprises means for decelerating the motion of said transporting means.

5. The aligning apparatus according to claim 1, wherein said stationary X-Y coordinate alignment means is angularly adjustable in the coordinate plane of said worksurface.

6. Apparatus for aligning, in the X and Y coordinate axes, a workpiece upon which manufacturing operations are to be performed, said apparatus comprising:

an X coordinate alignment means comprising a first plate substantially perpendicular to a work surface for transporting said workpiece to a predetermined X-coordinate position on said work surface and a pneumatic cylinder for actuating said first workpiece transporting plate;

a Y coordinate alignment means comprising a second plate substantially perpendicular to said work surface for transporting said workpiece to a predetermined Y-coordinate position on said worksurface and a pneumatic cylinder for actuating said second workpiece transporting plate;

a stationary X-Y coordinate alignment means for simultaneous alignment of said workpiece in the X and Y coordinate axes disposed along the path of travel of said workpiece;

an X coordinate sensing means for ascertaining placement of said workpiece at said predetermined X-coordinate position, said X-coordinate sensing means provided at a fixed position relative to said predetermined X-coordinate position;

a Y coordinate sensing means for ascertaining placement of said workpiece at said predetermined Y-coordinate position, sad Y-coordinate sensing means provided at a fixed position relative to said predetermined Y-coordinate position;

said X-coordinate alignment means further comprising means for slowing the motion of said first plate as said X-coordinate position is approached; and said Y-coordinate alignment means further comprising means for slowing the motion of said second plate as said Y-coordinate position is approached.

7. The aligning apparatus of claim 6, wherein said stationary X-Y coordinate alignment means comprises a wall vertically disposed to said work surface.

8. The aligning apparatus of claim 6, wherein said stationary X-Y coordinate alignment means comprises a wall vertically disposed to said worksurface, said wall being angularly adjustable in the coordinate plane of said worksurface.

9. An apparatus for simultaneously aligning in the X and Y coordinates axes, a workpiece upon which manufacturing operations are to be performed, said apparatus comprising:

an X coordinate alignment means, said X coordinate alignment means comprising means for transporting said workpiece in a path along the X-axis to a predetermined X-coordinate position on a work surface;

a Y coordinate alignment means, said Y coordinate alignment means comprising means for transporting said workpiece in a path along the Y-axis to a predetermined Y-coordinate position on said work surface;

a stationary X-Y coordinate alignment means provided along the path of movement of said workpiece and cooperating with said X and Y coordinate alignment means for simultaneous alignment of said workpiece in the X and Y coordinate axes;

a workpiece detecting means for detecting the presence of said workpiece upon said work surface; and a coordinate sensing means for ascertaining placement of said workpiece at either said predetermined X-coordinate position or said Y-coordinate position which is provided at a fixed position relative to either said predetermined X-coordinate position or said predetermined Y-coordinate position.

10. The aligning apparatus of claim 9, further comprising control means responsive to signals generated from said workpiece detecting means and said coordinate sensing means.

11. The aligning apparatus according to claim 9, further comprising means for decelerating the motion of said X-coordinate alignment means and said Y-coordinate alignment means.

12. An apparatus for simultaneously aligning, in the X and Y coordinate axes, a workpiece upon which manufacturing operations are to be performed, said apparatus comprising:

an X coordinate alignment means, said X coordinate alignment means comprising means for transporting said workpiece in a path along the X-axis to a predetermined X-coordinate position on a work surface;

a Y coordinate alignment means, said Y coordinate alignment means comprising means for transporting said workpiece in a path along the Y-axis to a predetermined Y-coordinate position on said work surface;

a stationary X-Y coordinate alignment means provided along the path of movement of said workpiece which cooperates with said X coordinate alignment means and said Y coordinate alignment means for simultaneous alignment of said workpiece in the X and Y coordinate axes;

an X coordinate sensing means for ascertaining placement of said workpiece at said predetermined X-coordinate position which is provided at a fixed position relative to said predetermined X-coordinate position;

a Y coordinate sensing means for ascertaining placement of said workpiece at said predetermined Y-coordinate position which provided at a fixed position relative to said predetermined Y-coordinate position;

material sensing means for detecting the presence of said workpiece on said work surface;

means for decelerating the motion of said X coordinate alignment means;

means for decelerating the motion of said y coordinate alignment means for controlling operation of said apparatus, said control means; and control means responsive to said X coordinate sensing means, said Y coordinate sensing means and said material sensing means.

13. The aligning apparatus according to claim 12, wherein said stationary X-Y coordinate alignment means is angularly adjustable in the coordinate plane of said worksurface.

14. Apparatus for aligning in the X and Y coordinate axes, a workpiece upon which manufacturing operations are to be performed, said apparatus comprising:

an X coordinate alignment means comprising a first plate substantially perpendicular to a work surface for transporting said workpiece to a predetermined X-coordinate position on said work surface and a pneumatic cylinder for actuating said first workpiece transporting plate;

a Y coordinate alignment means comprising a second plate substantially perpendicular to said worksurface for transporting said workpiece to a predetermined Y-coordinate position on said work surface and a pneumatic cylinder for actuating said second workpiece transporting plate;

a stationary X-Y alignment means disposed along the path of travel of said workpiece and cooperating with said X coordinate alignment means and said Y coordinate alignment means for simultaneous alignment of said workpiece in the X and Y coordinate axes, said stationary X-Y alignment means comprising a third plate substantial perpendicular to said worksurface which is angularly adjustable in the plane of said worksurface;

an X coordinate sensing means for ascertaining placement of said workpiece at said predetermined X-coordinate position which is provided at a fixed position relative to said predetermined X-coordinate position;

a Y coordinate sensing means for ascertaining placement of said workpiece at said predetermined Y-coordinate position which is provided at a fixed position relative to said predetermined Y-coordinate position;

said X-coordinate alignment means further comprising means for slowing the motion of said first plate as said X-coordinate position is approached;

said Y-coordinate alignment means further comprising means for slowing the motion of said second plate as said Y-coordinate position is approached; and control means, for controlling operation of said apparatus, said control means responsive to signals generated by said material sensing means, said X coordinate sensing means, or said Y-coordinate sensing means.

* * * * *

UNITED STATES PATENT AND TRADEMARK OFFICE

CERTIFICATE OF CORRECTION

PATENT NO. : 5,129,644

DATED : July 14, 1992

INVENTOR(S) : David G. Thomason, et al

It is certified that error appears in the above-indentified patent and that said Letters Patent is hereby corrected as shown below:

Col. 12, claim 12, line 36, after "alignment means" delete "for controlling operation of", at line 37 delete "said apparatus, said control means", and at line 38, after "control means" insert --for controlling operation of said apparatus, said control means--.

Signed and Sealed this

Fifth Day of October, 1993

*Attest:*

*Attesting Officer*

BRUCE LEHMAN

*Commissioner of Patents and Trademarks*